US012543780B2

(12) United States Patent
Varas

(10) Patent No.: US 12,543,780 B2
(45) Date of Patent: Feb. 10, 2026

(54) SMOKELESS PIPE AND METHOD OF OPERATING SAME

(71) Applicant: Anthony Varas, Dania Beach, FL (US)

(72) Inventor: Anthony Varas, Dania Beach, FL (US)

( * ) Notice: Subject to any disclaimer, the term of this patent is extended or adjusted under 35 U.S.C. 154(b) by 1059 days.

(21) Appl. No.: 17/199,627

(22) Filed: Mar. 12, 2021

(65) Prior Publication Data

US 2021/0282453 A1 Sep. 16, 2021

Related U.S. Application Data

(60) Provisional application No. 62/988,786, filed on Mar. 12, 2020.

(51) Int. Cl.
*A24F 1/00* (2006.01)
*A24F 1/32* (2006.01)
*A24F 13/06* (2006.01)

(52) U.S. Cl.
CPC ..... *A24F 1/32* (2013.01); *A24F 13/06* (2013.01)

(58) Field of Classification Search
CPC ..... A24F 1/00; A24F 1/24; A24F 1/28; A24F 9/00; A24F 9/14; A24F 9/16; A24F 5/00; A24F 5/02; A24F 5/04; A24F 5/10
USPC ..... 131/330, 176, 240.1
See application file for complete search history.

(56) References Cited

U.S. PATENT DOCUMENTS 606,473 A * 6/1898 Palmer
4,066,088 A 1/1978 Ensor
4,213,469 A * 7/1980 Ramsay ..... A24F 1/02 131/222
4,259,971 A 4/1981 Orter
4,278,099 A 7/1981 Jacobsen
4,281,672 A 8/1981 Caraway
4,569,136 A * 2/1986 Loring ..... A24F 42/20 131/273
4,790,332 A 12/1988 Wallace
5,472,001 A 12/1995 Nicholson
5,598,853 A 2/1997 Hyre
5,908,479 A 6/1999 Wampole
6,345,625 B1 2/2002 Chew
6,431,176 B1 8/2002 Rice
7,530,357 B2 5/2009 Edwards, Jr.
7,735,494 B2 6/2010 Bollinger et al.
2008/0230077 A1 9/2008 Martilik
2017/0099874 A1 * 4/2017 Reimann ..... A24F 1/32
2020/0305507 A1 10/2020 Shenkal et al.

* cited by examiner

*Primary Examiner* — Eric Yaary
*Assistant Examiner* — Yana B Krinker
(74) *Attorney, Agent, or Firm* — The Concept Law Group, PA; Scott D. Smiley; Scott M. Garrett

(57) ABSTRACT

A smoking pipe apparatus includes a pipe body that has a bowl portion and a stem portion attached to the bowl portion. The bowl portion includes a bowl cavity in which a bowl sits. A bowl retainer fits over the bowl at the top of the pipe body, and further holds a bowl cover that has an opening. The pipe body has a lower extension that alternatively acts as a stand for the pipe body, and is configured to couple to a filter element. A one-way valve is attached to the bottom of a floor of the bowl cavity to normally block the passage of air/gasses through holes in the floor of the bowl cavity, but which opens when a user exhales into the pipe apparatus so that exhaled gasses pass through the filter element.

14 Claims, 16 Drawing Sheets

SMOKELESS PIPE AND METHOD OF OPERATING SAME

CROSS-REFERENCE

This application claims priority to U.S. provisional application No. 62/988,786, filed Mar. 12, 2020, the entirety of which is hereby incorporated by reference.

FIELD OF THE INVENTION

The present invention relates generally to pipes for smoking, and, more particularly, relates to a smokeless pipe that reduces, if not eliminates, exhaled smoke.

BACKGROUND OF THE INVENTION

Smoking has long been an activity enjoyed by people, and it has cultural and social relevance in many places. In recent years social acceptance of smoking has shifted, and in many jurisdictions it has been banned in certain public places and workplaces. Furthermore, even outside of places where smoking is prohibited, people will seek to reduce the secondary effects on non-smokers, as well as that of surrounding environments. As a result, there is strong desire to limit the amount of smoke produced by a smoking apparatus, such as a pipe. Prior art solutions provide for various filters, but these tend to be for inhaling, reducing the effectiveness of the smoking apparatus.

A number of attempts have been made to incorporate filters into pipes, which involve the user exhaling through a filter. These have so far proven to be suboptimal, resulting in excessive fouling of the filter, and requiring the user to block off the inhalation pathway potentially exposing the user to burns.

Therefore, a need exists to overcome the problems with the prior art as discussed above.

SUMMARY OF THE DISCLOSURE

The inventive embodiments of the disclosure provide a smoking pipe apparatus that includes a pipe body having a bowl portion and a stem portion. The bowl portion has bowl cavity with a top opening, and the bowl cavity is configured to receive a bowl into the bowl cavity. The apparatus can further include a retention shoulder formed around the top opening. The bowl cavity has a floor with a plurality of openings therethrough. The pipe body further has a lower extension that extends downward from a bottom of the bowl portion. The stem portion extends from the bowl portion and includes a bore through the stem portion that is contiguous with the bowl cavity of the bowl portion. The apparatus can further include a one-way valve disposed on a bottom of the floor of the bowl cavity that normally closes off the plurality of openings through the floor and is closed when a pressure inside the bowl cavity is lower than an ambient pressure outside the smoking pipe apparatus. The one-way valve opens when the pressure inside the bowl cavity is higher than the ambient pressure. The apparatus can further include a bowl retainer that is configured to mate with and be removable retained by the retention shoulder of the pipe body and to retain the bowl in the bowl cavity of the pipe body. The bowl retainer further has a top opening. A bowl cover is configured to fit into, and be retained at, the top opening of the bowl retainer. The bowl cover has an opening through the bowl cover.

In accordance with a further feature, the pipe body further includes an opening through a side wall of the bowl portion to the cavity.

In accordance with a further feature, the smoking pipe apparatus further includes a filter element that is configured to couple to the lower collar of the pipe body.

In accordance with a further feature, the one-way valve is a flapper valve that is removably coupled to the floor of the cavity of the bowl portion of the pipe body.

In accordance with a further feature, the pipe body is made of silicone.

In accordance with a further feature, the bowl cover is made of glass.

In accordance with a further feature, the lower extension of the pipe body has a bottom, the bottom having a front portion and a back portion, the back portion being under a location on the bowl portion where the bowl portion couples to the stem portion, and wherein the back portion of the lower extension extends further downward than the front portion of the lower extension such that the bottom of the lower extension is angled.

In accordance with a further feature, the bottom of the lower extension is angled between twenty and thirty degrees relative to horizontal.

The inventive embodiments of the disclosure also provide a smoking pipe apparatus that includes a pipe body having a bowl portion and a stem portion. The stem portion extends from a side of the bowl portion. The bowl portion has a bowl cavity that has an opening at a top of the bowl portion, and the bowl cavity has a floor. The bowl portion has a retaining shoulder formed on a top of the bowl portion around the opening of the bowl cavity. The stem portion has a bore through the stem portion that connects to the bowl cavity. The floor of the bowl cavity has a plurality of vent extensions that extend upwards from the floor, where each vent extension of the plurality of vent extensions has a vertical channel through the vent extension that further passes through the floor of the bowl cavity. A lower extension extends downward from a bottom of the bowl portion. The lower extension has a bottom, that has a front portion and a back portion. The back portion being under a location on the bowl portion where the bowl portion couples to the stem portion, and the back portion of the lower extension extends further downward from the bowl portion than the front portion of the lower extension such that the bottom of the lower extension is angled.

In accordance with a further feature, the apparatus further includes a one-way valve disposed on a bottom of the floor of the bowl cavity, wherein the one-way valve normally closes off each channel through the plurality of vent extensions as well as when a pressure inside the bowl cavity is lower than an ambient pressure outside the smoking pipe apparatus, and wherein the one-way valve opens when the pressure inside the bowl cavity is higher than the ambient pressure.

In accordance with a further feature, the apparatus further includes a filter element having a grove configured to receive the bottom of the lower extension of the pipe body. The filter element further includes an extension wall that extends into an opening formed by the lower extension. The top of the extension wall has a plurality of notches that allow gasses to pass into the filter element when the one-way valve is opened.

In accordance with a further feature, the apparatus further includes a bowl configured to fit into the bowl cavity, the bowl having a lip that rests on a top of the retention shoulder when the bowl is inserted into the bowl cavity, and the bowl having a plurality of openings through a floor of the bowl. The apparatus further includes a bowl retainer that is configured to mate with and be removably retained by the retention shoulder of the pipe body and to retain the bowl in the bowl cavity of the pipe body when retained by the retention shoulder, and the bowl retainer further having a top opening. The apparatus further includes a bowl cover that is configured to fit into and be retained at the top opening of the bowl retainer, the bowl cover having an opening through to bowl cover.

In accordance with a further feature, the bottom of the lower extension is angled between twenty and thirty degrees relative to horizontal.

In accordance with a further feature, the bowl portion has a side opening through a wall of the bowl portion to the bowl cavity.

The inventive embodiments of the disclosure also provides a method using a smoking pipe apparatus. The method comprises providing a smoking pipe apparatus which includes a bowl, and a pipe body that has a bowl portion and a stem portion. The bowl portion has a bowl cavity therein with a top opening configured to receive the bowl into the bowl cavity. There is a retention shoulder formed around the top opening. The bowl cavity has a floor, and the floor has a plurality of openings therethrough. The pipe body further has a lower extension that extends downward from a bottom of the bowl portion. The stem portion extends from the bowl portion and includes a bore through the stem portion that is contiguous with the cavity of the bowl portion. The apparatus further includes a one-way valve disposed on a bottom of the floor of the bowl cavity. The one-way valve normally closes off the plurality of openings through the floor and closes off the openings when a pressure inside the bowl cavity is lower than an ambient pressure outside the smoking pipe apparatus. The one-way valve opens when the pressure inside the bowl cavity is higher than the ambient pressure. The apparatus further includes a bowl retainer that is configured to mate with, and be removable retained by, the retention shoulder of the pipe body, and is further configured to retain the bowl in the bowl cavity of the pipe body. The bowl retainer has a top opening, and a bowl cover is configured to fit into and be retained at the top opening of the bowl retainer. The bowl cover has an opening through the bowl cover. Upon providing the smoking pipe apparatus substantially as recited, the method further includes attaching a filter element to the lower extension of the pipe body, placing smoking material into the bowl, igniting the smoking material, and placing the bowl retainer and bowl cover onto the top of the bowl body and into engagement with the retention shoulder. With the opening through the bowl cover open, the method further includes drawing through the stem portion thereby causing air to pass through the opening through the bowl cover and creating smoke which is drawn through the stem portion. The method further includes covering the opening through the bowl cover and exhaling through the stem portion, thereby causing the one-way valve to open and gasses exhaled through the stem portion to pass through the open one-way valve and through the filter element.

In accordance with a further feature, providing the smoking pipe apparatus further comprises providing a side opening through the bowl portion to the bowl cavity. Drawing through the stem portion is initially performed with the side opening closed, and the method further includes, after initially drawing through the stem portion with the opening through the bowl cover open and prior to exhaling through the stem portion, covering the opening through the bowl cover and opening the side opening while drawing through the stem portion, and prior to exhaling through the stem portion, covering the side opening.

Although the invention is illustrated and described herein as embodied in a smoking pipe apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. To the extent that the inventive disclosure relies on or uses software or computer implemented embodiments, the terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

The inventive smoking pipe apparatus allows a user to greatly reduce the effect of smoking on others by providing a filter and a valve system in the pipe apparatus. The user can both inhale through the pipe to receive smoke, and exhale through the pipe wherein a valve directs the smoke through a filter element. The pipe apparatus further allows the user to clear the pipe of smoke when drawing through the pipe.

Figure 1:
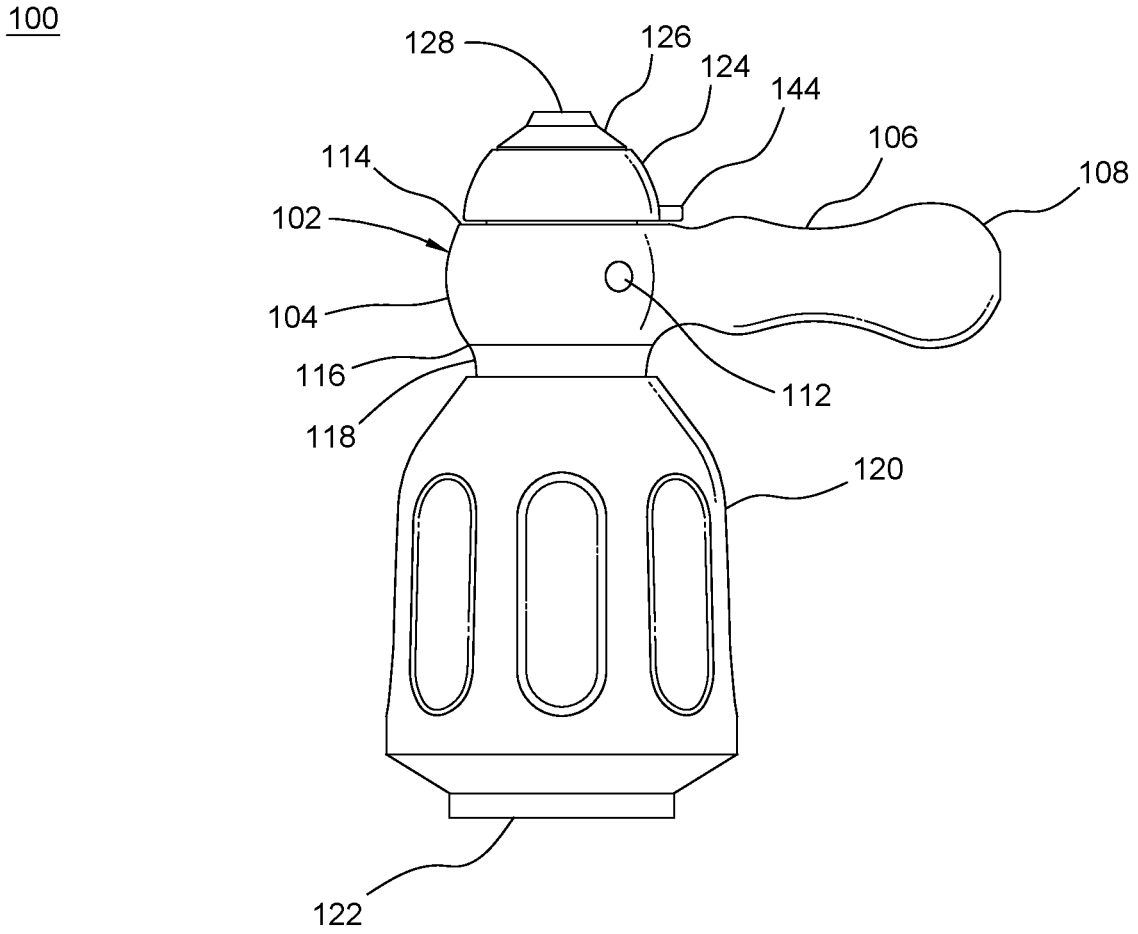
FIG. 1 shows a side view of a smoking pipe apparatus, in accordance with some embodiments.

FIG. 1 shows a side view of a smoking pipe apparatus 100, in accordance with some embodiments. FIGS. 1-9 relate to the same or similar embodiments and some elements shown in these drawings are not visible in all of the drawings. The apparatus 100 include a pipe body 102 which comprises a bowl portion 104 and a stem portion 106. The bowl portion 104 holds the bowl 200 in a bowl cavity 148, and the bowl 200 holds the smoking material (e.g. tobacco). The stem portion 106 of the pipe body 102 extends from the bowl portion and includes a bore 150 through the stem portion 106 that is connects to the bowl cavity 148 and extends to the distal end 108 of the stem portion 106. The distal end 108 of the stem portion 106 acts as a mouthpiece and is where the user can place their mouth to draw smoke through the pipe, which results in air being drawn through the smoking material thereby creating smoke (assuming the smoking material is ignited), through openings 208 in the bottom of the bowl, and through the bowl cavity and 148 and bore 150 of the stem portion 106. The pipe body 102 can be made of a non-ignitable material that is resistant to heat, such as, for example, silicone, metal, stone, and so on. The pipe body can also have a side opening 112 that passes through the side of the bowl portion 104 to the bowl cavity 148, and is sized to allow a user to selectively cover the side opening 112 during use. By uncovering the side opening 112 and drawing through the stem portion 106, any smoke in the bowl chamber 148 will be cleared through the stem portion 106. Covering the side opening 112 and drawing through the stem portion 106 will then force air to come through the bowl 200, drawing smoke from the burning smoking material in the bowl 200 through the stem portion 106.

Figure 2:
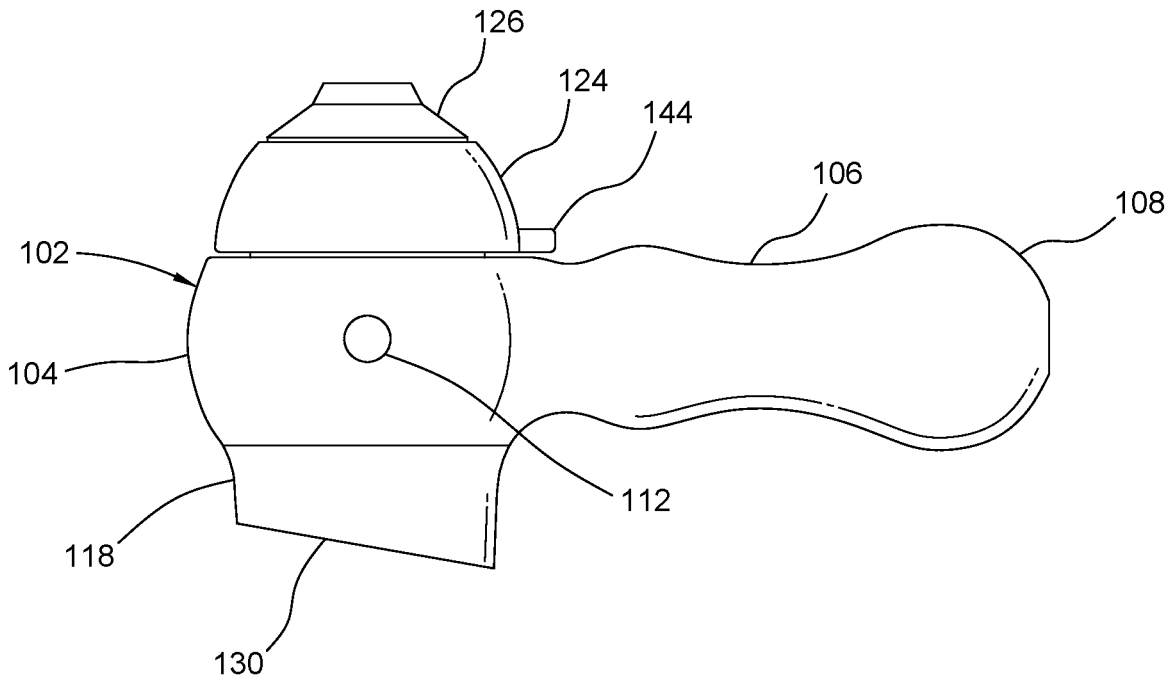
FIG. 2 shows a side view of a pipe body and cover of a smoking pipe apparatus, in accordance with some embodiments.

In FIG. 2, the lower extension 118 of the pipe body can be seen extending downward form the bottom 116 of the bowl portion 104. The lower extension 118 has a bottom 130 that is open to receive a connecting portion of the filter element 120 therein, when the pipe body 102 is used with the filter element 120. A user can also use the pipe body 102 as shown here, without the filter element (with the bowl 200 and, optionally, the bowl retainer 124 and bowl cover 126).

When used with the filter element 120 the lower extension 118 interfaces with a similarly shaped feature in the top of the filter element 120 to retain the pipe body 102 onto the filter element 120. The bottom 130 of the lower extension 118 is angled such that the front, at the side of the pipe body 102 that is opposite where the stem portion 106 connects to the bowl portion 104, is shorter than the back portion. The back portion being where the stem portion 106 meets the bowl portion 106. That is, the back portion of the lower extension extends downward farther than the front portion of the lower extension 118. The lower extension is like a skirt in that it is a wall that extends downward from the bowl portion 104. The angled bottom allows the pipe body to be balanced when used without the filter element 120; the user can set the pipe body down on a surface such that the bottom 130 of the lower extension 118 rests on the surface. As a result, the stem portion 106 will be angled upwards, and the center of gravity of the bowl portion will be shifted forward to counteract the torque on the bowl portion 104 resulting from the stem portion 106 due to it extending way from the bowl portion 104. The angle of the bottom can be in the range of ten to forty five degrees, with a preferable range on the order of twenty to thirty degrees from horizontal (the longitudinal axial direction of the stem portion 106 as shown here defining horizontal).

On top of the pipe body 102 is a bowl retainer 124 and a bowl cover 126. The bowl retainer 124 is made of a resilient material that can deform but which tends to hold/return to its original shape, and interfaces with a retention shoulder 132 to retain the bowl retainer 124 onto the pipe body 102. Further the bowl cover 126 is similarly retained in the top of the bowl retainer 124. The bowl retainer 124 can be an annular structure that is open at its bottom and top. Further, the bowl retainer can have a semi-spherical shape that follows a semi-spherical shape of the bowl portion 104 of the pipe body 102. The bowl cover 126, which is retained in the bowl retainer 124 at the top opening 138 of the bowl retainer 124, has a top opening 128 that can be on the order of 5-10 millimeters in diameter, and is sized to allow a user to cover the opening 128 with their thumb or other finger while using the pipe apparatus 100, as will be explained. The bowl cover 126 can be annular and fit into the circular top opening of the bowl retainer 124. The bowl cover 126 can be made of a rigid transparent material, such as glass.

Figure 3:
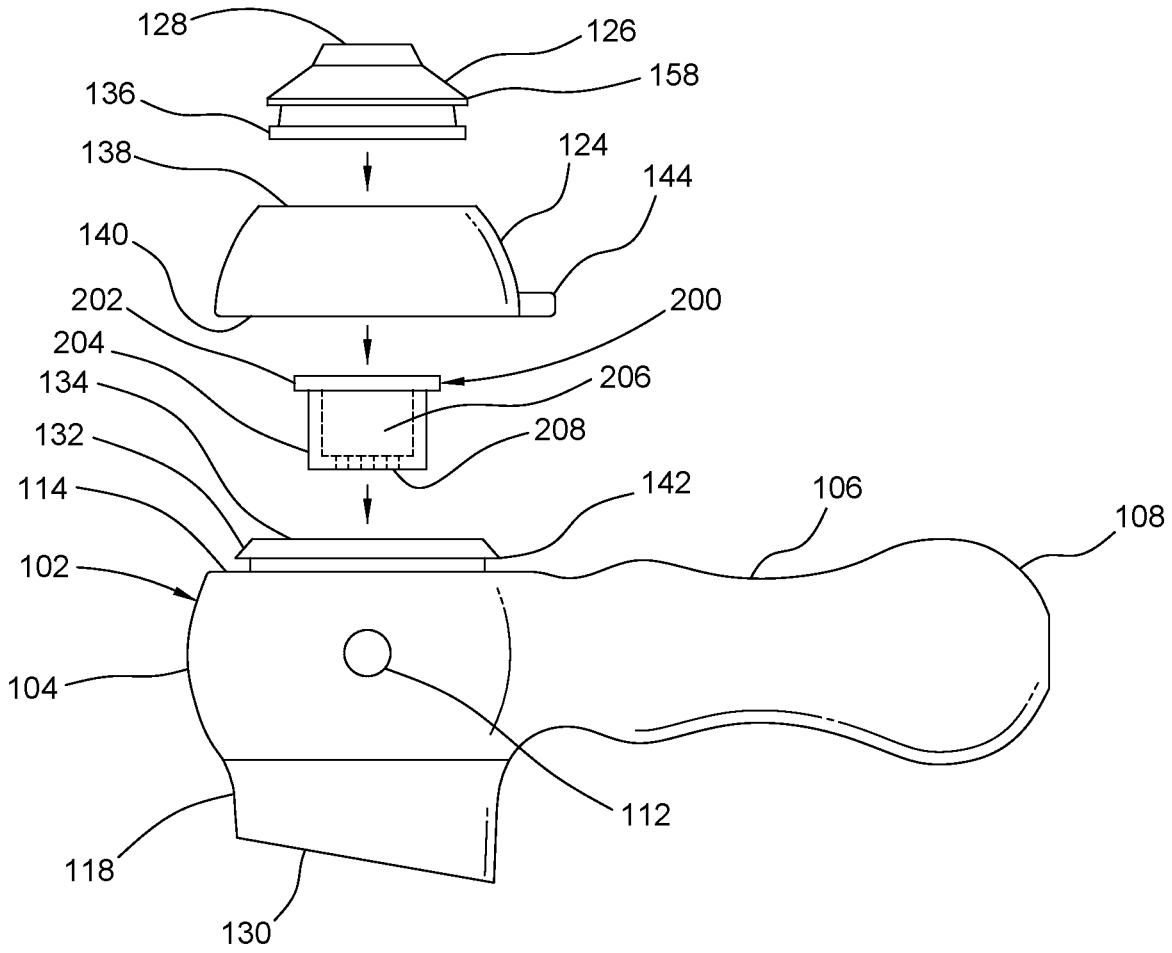
FIG. 3 shows a side exploded view of a pipe body and cover, in accordance with some embodiments.
Figure 4:
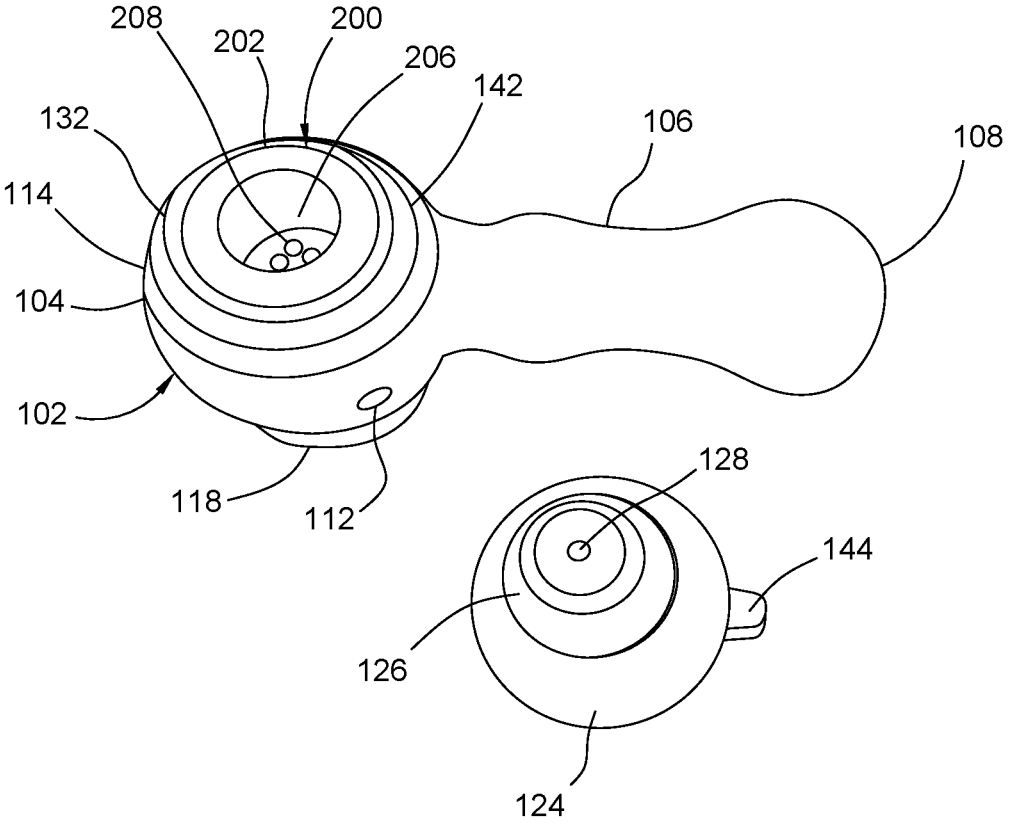
FIG. 4 shows a top-side perspective view of a pipe body and cover, with the cover removed, in accordance with some embodiments.
Figure 5:
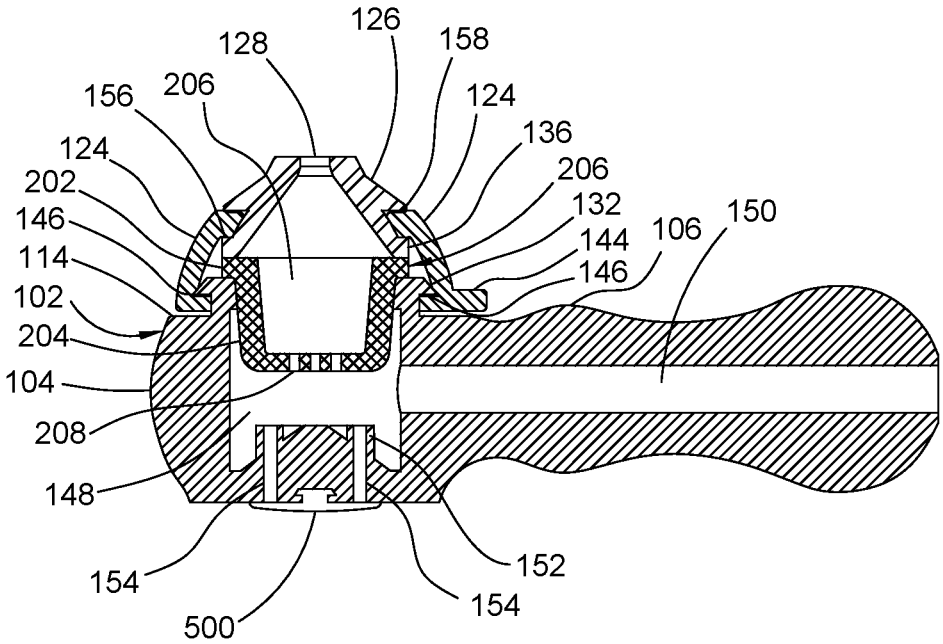
FIG. 5 shows a side cross section view of a pipe body and cover, in accordance with some embodiments.

FIG. 3 shows a side exploded view of a pipe body 102, bowl retainer 124, and bowl cover 128, along with the bowl 200. FIG. 5 shows a side cross-sectional view of these elements assembled together. FIG. 4 shows a top-side perspective view of these elements assembled, but with the bowl retainer 124 and bowl cover 126 removed from the pipe body 102. The bowl 200 can be a glass element that has a top lip 202 and a bowl body 204. Inside the bowl body 204 is a space 206 for holding smoking material. The bottom of the bowl has openings 208 through which smoke can be drawn. A screen could be equivalently used in the bottom of the bowl 200. The bowl 200 sits in the bowl cavity 148 of the pipe body 102, and the lip 202 of the bowl rests against the top of the retention shoulder 132 to prevent the bowl 200 from falling further into the bowl cavity 148, and to allow a user to remove the bowl 200 for washing/cleaning.

As shown particularly in FIG. 5, the retention shoulder 132 is an annular structure on an extension that extends upward from the top 114 of the pipe body 102 around the opening 134 to the bowl cavity 148. The retention shoulder 132 has a retaining ledge 142 that extends outward from the extension, over the top 114 of the pipe body such that there is a vertical gap between the top 114 of the pipe body 102, and the bottom the retaining ledge 142, creating a space under the retaining ledge 142 around the retention shoulder 132. The bowl retainer 124 includes a lower inward facing retention lip 146 the fits into the gap between the retaining ledge 142 and the top 114 of the pipe body 102 to create a vertical interference that retains the bowl retainer 124 on the pipe body 102. The bowl cover 126 includes a lower retaining lip 136 and an upper retaining lip 158, both of which extend outward, laterally. A gap is formed between the lower retaining lip 136 and the upper retaining lip 158 of the bowl cover, and the upper retaining lip 156 at the top of the bowl retainer 124 fits into this gap to retain the bowl cover 126 onto the bowl retainer 124. The bowl cover 126 is open at its top (opening 128) and is essentially an annular wall surrounding an open volume in the shape of a conic section. The bottom of the outward facing lower retaining lip 136 can make contact with the top of the lip 202 of the bowl 200 to hold the bowl 200 in place in the pipe body when the bowl retainer 124 is retained on the retention shoulder 132. A tab 144 can extend outward from the bottom of the bowl retainer 124 that can be lifted by a user to remove the bowl retainer 124 from engagement with the retention shoulder 132 of the pipe body.

In use, with the bowl retainer 124 removed from the pipe body 102, the user can place the bowl 200 into the bowl cavity 148, and then place smoking material into the space 206 of the bowl 200. Upon igniting the smoking material, the user can then place the subassembly of the bowl retainer 124 with the bowl cover 126 in the top of the bowl retainer 124 onto the retention shoulder 132 of the pipe body. Thereafter the pipe is ready for one mode of use. As mentioned, the pipe body 102 can be used with or without the filter element 120. It is further contemplated that other elements, in addition to the filter element 120, can be configured to couple to the pipe body 102 at the lower extension 118. For example, a hookah pipe can be configured to receive the lower extension 118 of the pipe body 102. In such an application, the stem portion 106 can be removed and the opening for coupling the stem portion 106 can be plugged or blocked, and the side opening 112 can likewise be plugged. Thereafter the pipe body 102 can be used as a hookah pipe component. The modularity of the pipe apparatus allows for various configurations and uses.

Figure 6:
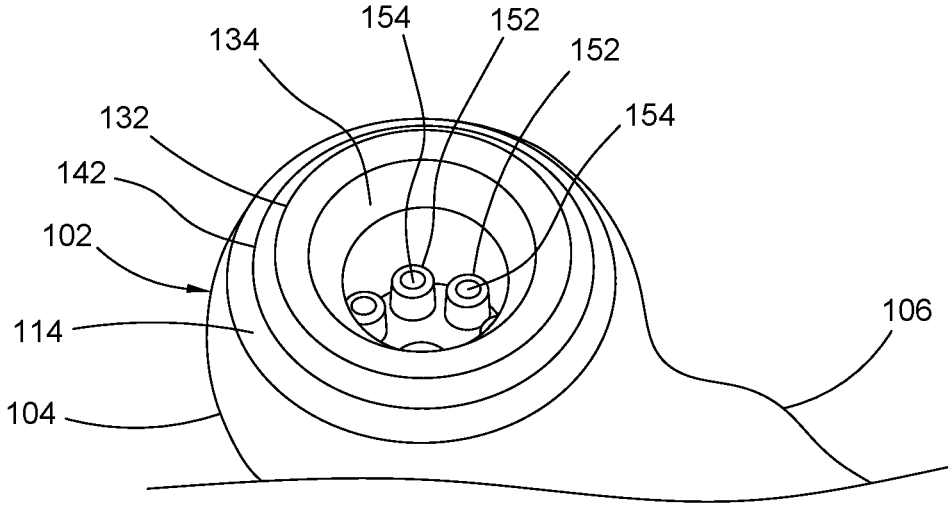
FIG. 6 shows a top-side perspective view of a pipe body with the bowl removed, showing details in the bowl cavity, in accordance with some embodiments.

At the bottom of the bowl cavity 148 there is a floor through which channels 154 pass. Several vent extensions 152 can extend upward from to floor of the bowl cavity 148, and each vent extension 152 can have a channel 154 through it. When the pipe body 102 is coupled to a filter element 120, as shown in FIG. 1, exhaled smoke can pass through the channels 154 into the filter element. The vent extensions 152, being raised above the floor of the bowl cavity 148, help to reduce the amount of moisture and other matter passing into the filter element. In that sense, the vent extensions 152 act as a first stage or pre-filter to allow the filter media of the filter element to last longer. In FIG. 5 a flapper valve 500 is shown at the underside of the floor of the bowl cavity 148, as will be discussed, the flapper valve 500 alternately opens/closes dependent on the pressure differential between the pressure in the bowl cavity 148 and the ambient pressure. FIG. 6 shows a top-side perspective view of a pipe body 102 with the bowl 200 removed, showing the vent extensions 152 and channels 154 in the floor of the bowl cavity 148.

The bottom of the channels 154 are normally covered by the disk 502 of a flapper valve 500 (as shown in FIG. 5), to prevent air from being drawn into the bowl cavity through the channels 154 (and filter element, if connected). The flapper valve 500 is made of a resilient material and includes the disk 500 or equivalent structure to cover and seal the bottom of the channels 154, normally. When the pressure inside the bowl cavity 148 is equal to, or lower than the ambient pressure, the disk 502 will remain over the bottom of the channels 154. When the pressure in the bowl chamber is higher than the ambient pressure, the pressure differential becomes sufficient to deflect the disk 502 downward, away from the bottom of the channels 154, allowing air/gas/smoke to pass through the channels 154 past the flapper valve 500. When the pipe body 102 is connected to the filter element 120, smoke can be forced through the filter element by covering the top opening 128 of the bowl cover 126 and the side opening 112 of the pipe body 102 and then exhaling smoke through the stem portion 106, which increases the pressure in the bowl cavity 148 sufficiently to deflect/open the flapper valve disk 502, allowing smoke to pass into the filter element.

Figure 7:
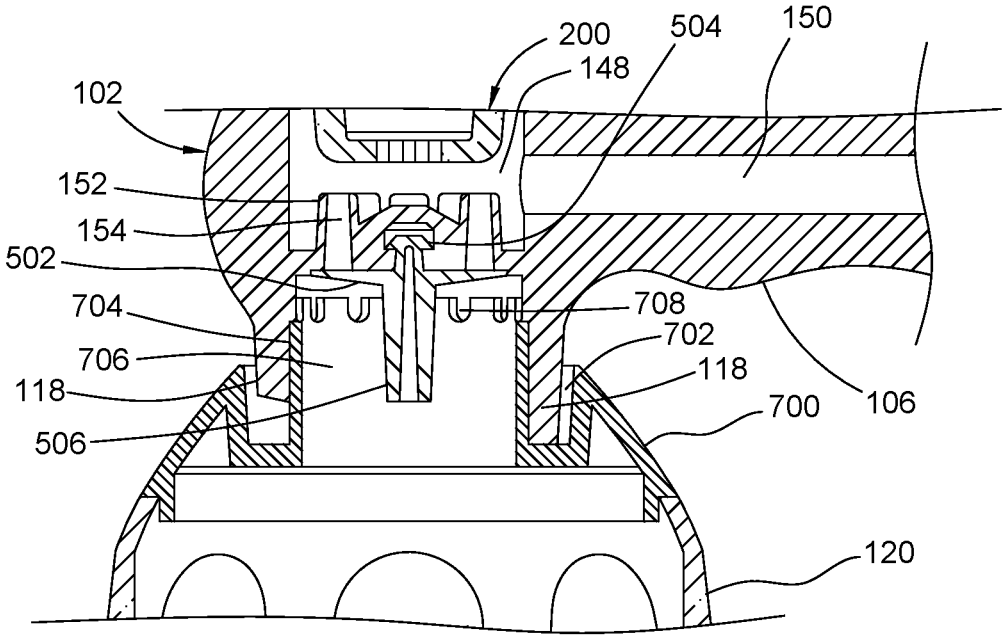
FIG. 7 shows a side cross-sectional view of a pipe body coupled to a filter element, in accordance with some embodiments.

FIG. 7 shows a side cross-sectional view of a pipe body 102 coupled to a filter element 120, in accordance with some embodiments. The top 700 of the filter element 120 includes an annular trough 702 that surrounds an annular wall 704 which extends upward from the top 700 of the filter element 120. The lower extension 118 of the pipe body 102 fits into the trough 702 and into frictional contact with the outside of the wall 704 to retain the pipe body 102 onto the filter element 120 and seal the pipe body 102 to the filter element 120 to ensure all exhaled gasses and matter pass through the filter element 120. The wall 704 surrounds a passage 706 that allows exhalations from the pipe body 102 to pass into the filter element 120. At the top of the wall 704 are a plurality of cutouts 708 that facilitate passage of exhaled gasses. Further, in this view, the stem 506 of the flapper valve can be seen. The stem 506 can be grasped by a user to insert or remove the flapper valve 500, in order to allow the user to periodically replace the flapper valve.

Figure 8:
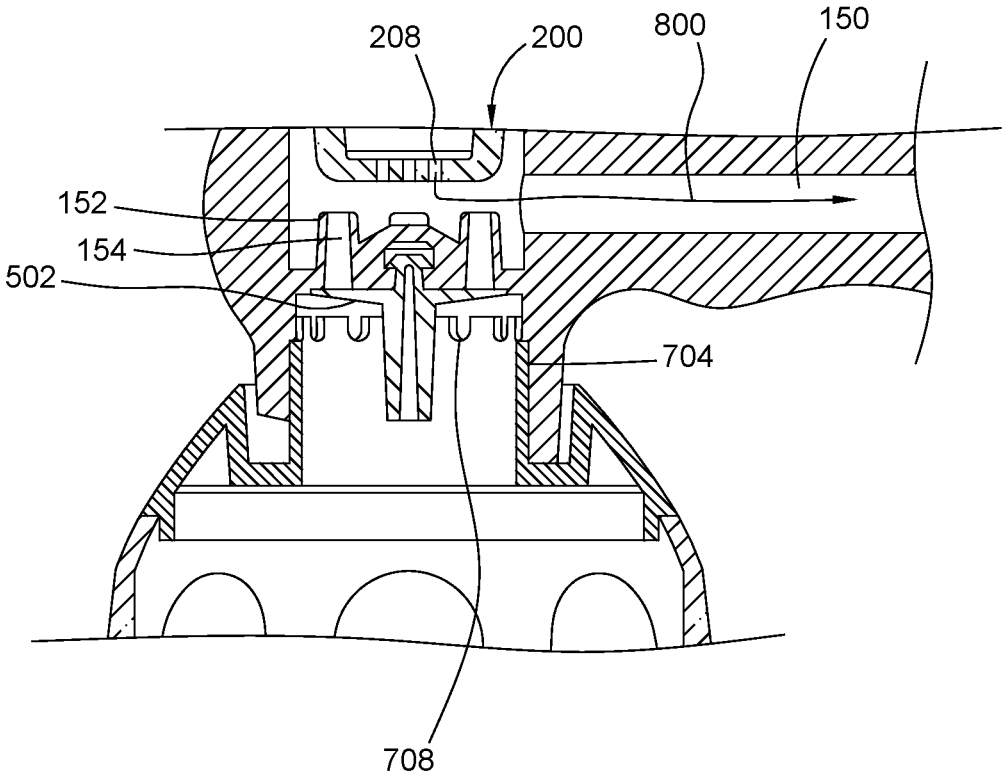
FIG. 8 shows a side cross-sectional view of a pipe body coupled to a filter element, illustrating a valve state when a user draws through the pipe body, in accordance with some embodiments.
Figure 9:
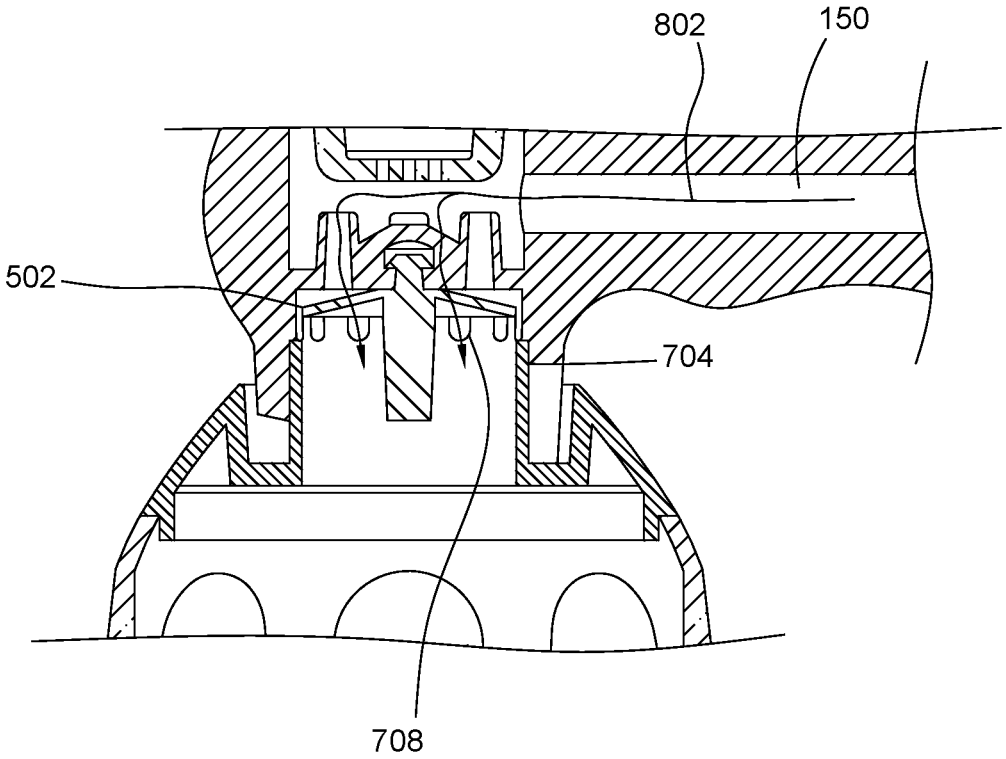
FIG. 9 shows a side cross-sectional view of a pipe body coupled to a filter element, illustrating a valve state when a user exhales through the pipe body, in accordance with some embodiments.

FIGS. 8 and 9 show the state of the flapper valve 500 is different modes of use. In FIG. 8, the user is inhaling, as indicated by the arrow 800. In this mode, initially the bowl cover opening 128 is open, and the side opening 112 is covered (e.g. with the user's thumb), drawing air through the bowl cover opening 128, through the bowl and any ignited smoking material there, and through the bore 150 of the stem portion 106 of the pipe body, as indicated by arrow 800. In this initial draw mode, the pressure in the bowl cavity relative to ambient pressure causes the flapper valve 500 to remain closed. After the initial draw, a user may wish to clear the pipe body of smoke by closing the bowl cover opening 128, opening the side opening 112, and continuing to inhale through the stem portion 106; again, in this mode, the pressure differential is such that the flapper valve 500 remains closed. In FIG. 9, however, both the bowl cover opening 128 and side open 112 are closed, and user exhales through the stem portion 106, as indicated by arrow 802. In this case the pressure in the bowl cavity 148 is such that the flapper valve disk 502 is deflected downward, opening channels 154 so that gasses can pass through cutouts 708 into the passage 706, and through the filter element 120 to be filtered.

Figure 10:
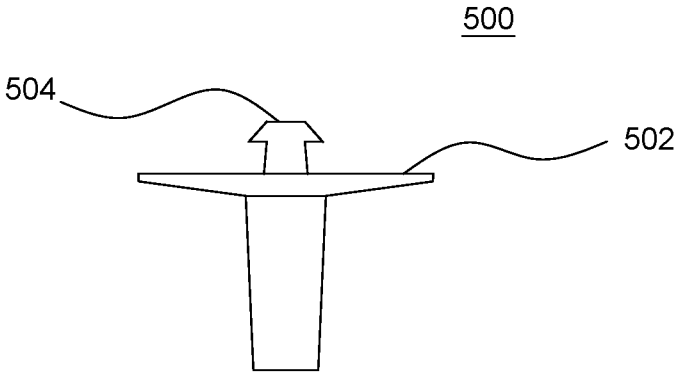
FIG. 10 shows a side view of flapper valve element, in accordance with some embodiments.
Figure 11:
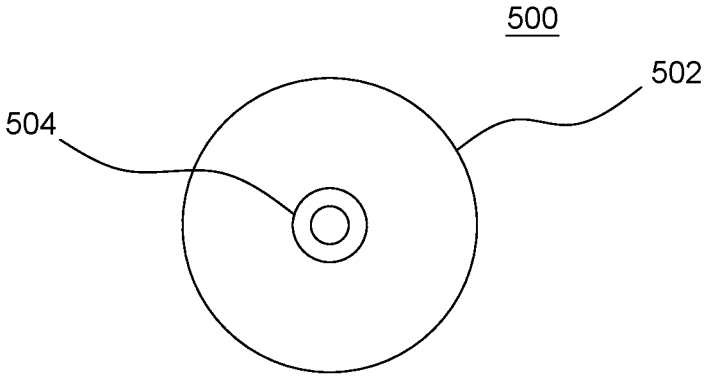
FIG. 11 shows a top view of a flapper valve element, in accordance with some embodiments.

FIG. 10 shows a side view of flapper valve 500, and FIG. 11 shows a top view of a flapper valve 500, in accordance with some embodiments. Those skilled in the art will recognize that equivalent valve designs can be used to achieve the desired "check valve" or one-way type of operation that is dependent on pressure differential. The exemplary flapper valve 500 includes a disk 502 that extends outward. The material of the flapper valve, being resilient, allows the disk, especially at the outer edge, to be deflected. The disk can be shaped to be biased in one direction by, for example, having the lower side of the disk 502 be thicker across the bottom closer to the stem 506 To retain the flapper valve 500 in the pipe body 102, the head 504 of the flapper valve can be inserted into a retaining feature/cavity in the pipe body such that ridge 508 resists removal of the flapper valve 500. However, a user can remove the flapper valve 500 for cleaning when desired, so the retention features are configured to allow removal of the flapper valve or the equivalent one-way valve used. Alternatively, the flapper valve 500 can be mounted on the filter element such that the flapper valve disk 502 comes into contact with the underside of the floor of the bowl cavity upon connecting the pipe body 102 to the filter element 120.

Figure 12:
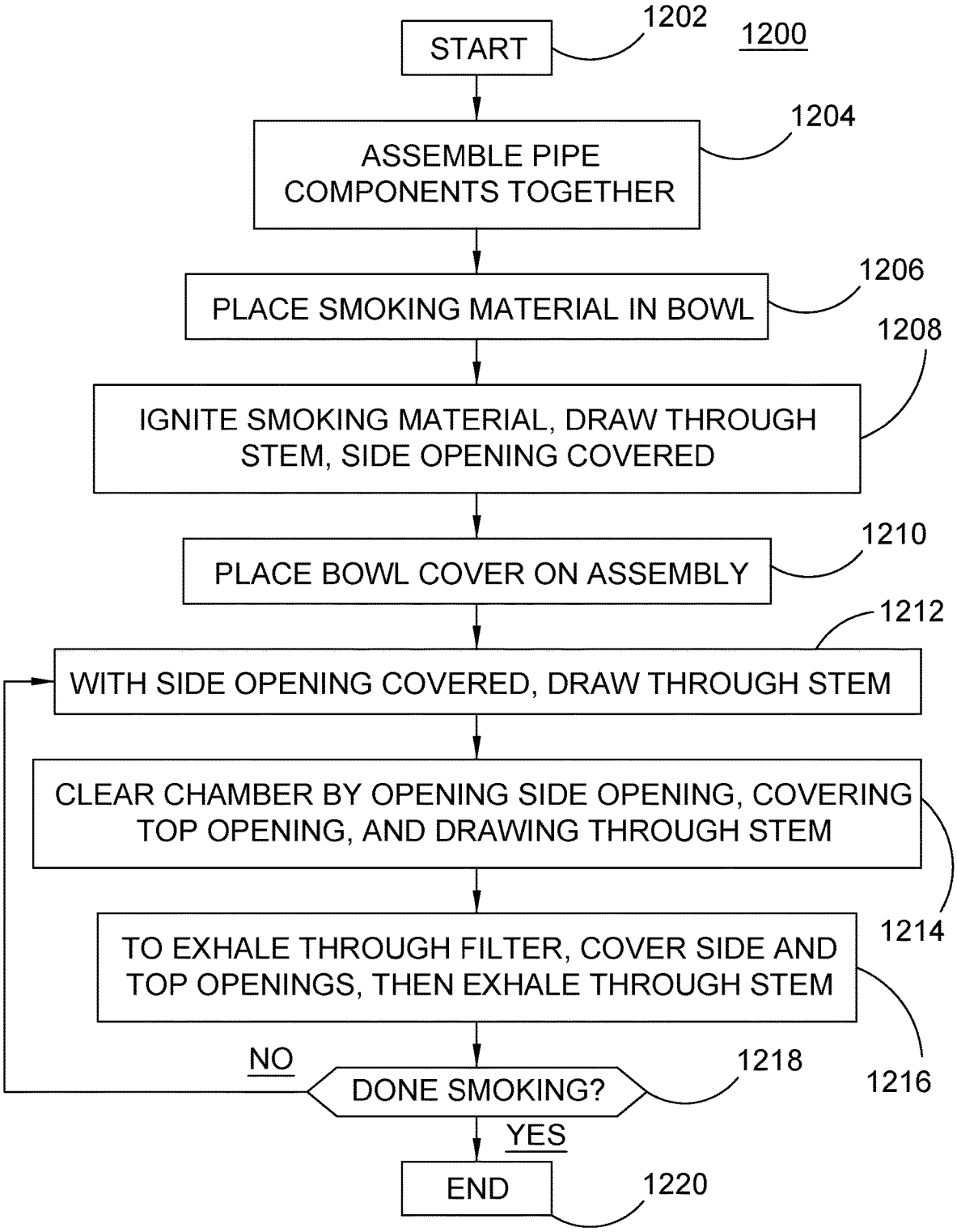
FIG. 12 shows a flow chart diagram of a method of using a smoking pipe apparatus, in accordance with some embodiments.

FIG. 12 shows a flow chart diagram of a method 1200 of using a smoking pipe apparatus, in accordance with some embodiments. At the start 1202 a user has the requisite pipe components as shown in accordance with FIGS. 1-11. In particular, a pipe body, bowl, bowl retainer, bowl cover, and filter element are collected and assembled in step 1204. In step 1206 the user can place smoking material in the bowl, and in step 1208 the user can ignite the smoking material by providing an ignition source (e.g. lighter or match), and drawing air through the smoking material by inhaling through the stem of the pipe body. Once the smoking material is ignited, then in step 1210 the user can place the bowl retainer with the bowl over in place onto the pipe body where the mechanical features of the pipe body the bowl retainer operate to retain the bowl retainer on the pipe body. Alternatively, the user can place the bowl retainer and bowl cover onto the pipe body before igniting the smoking material, and ignite the smoking material through the hole in the bowl cover. In step 1212, with the side opening covered and the bowl cover opening open, the user can inhale, drawing air through the burning smoking material, creating smoke that passes to the user through the stem portion of the pipe body. In step 1214 the user can clear the bowl cavity (chamber) by covering the bowl cover opening and opening the side opening, and inhaling, or continuing to inhale through the stem. To exhale and filter the smoke, the user, in step 1216, covers both the bowl cover opening and the side opening, and exhales into the stem, causing the flapper valve to open and the exhaled gasses to pass through the filter element. As indicated in decision box 1218, the user can repeat this process until they are finished, at which point the method 1200 ends 1220.

Figure 13:
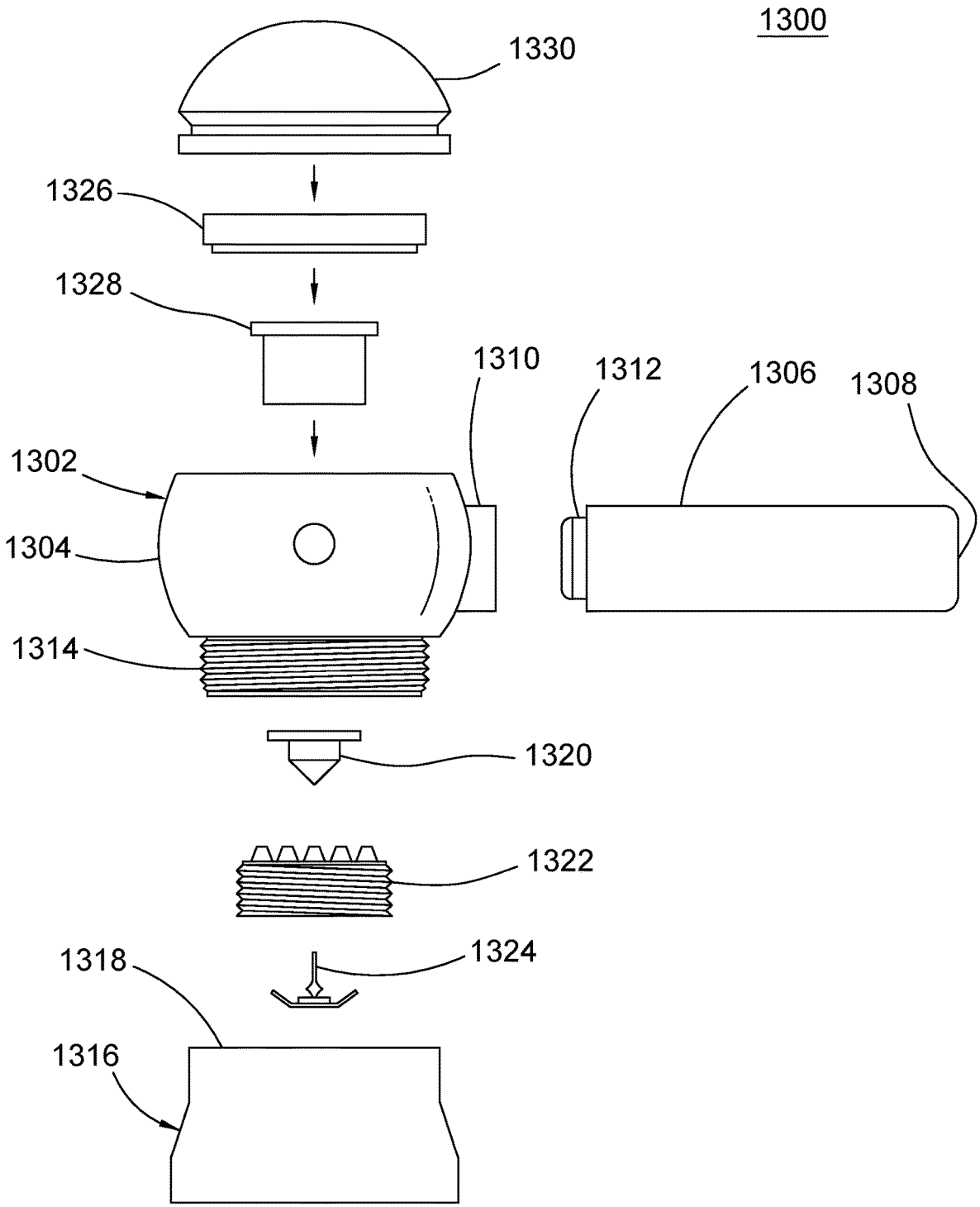
FIG. 13 shows a side-exploded view of a smoking pipe apparatus, in accordance with some embodiments.
Figure 14:
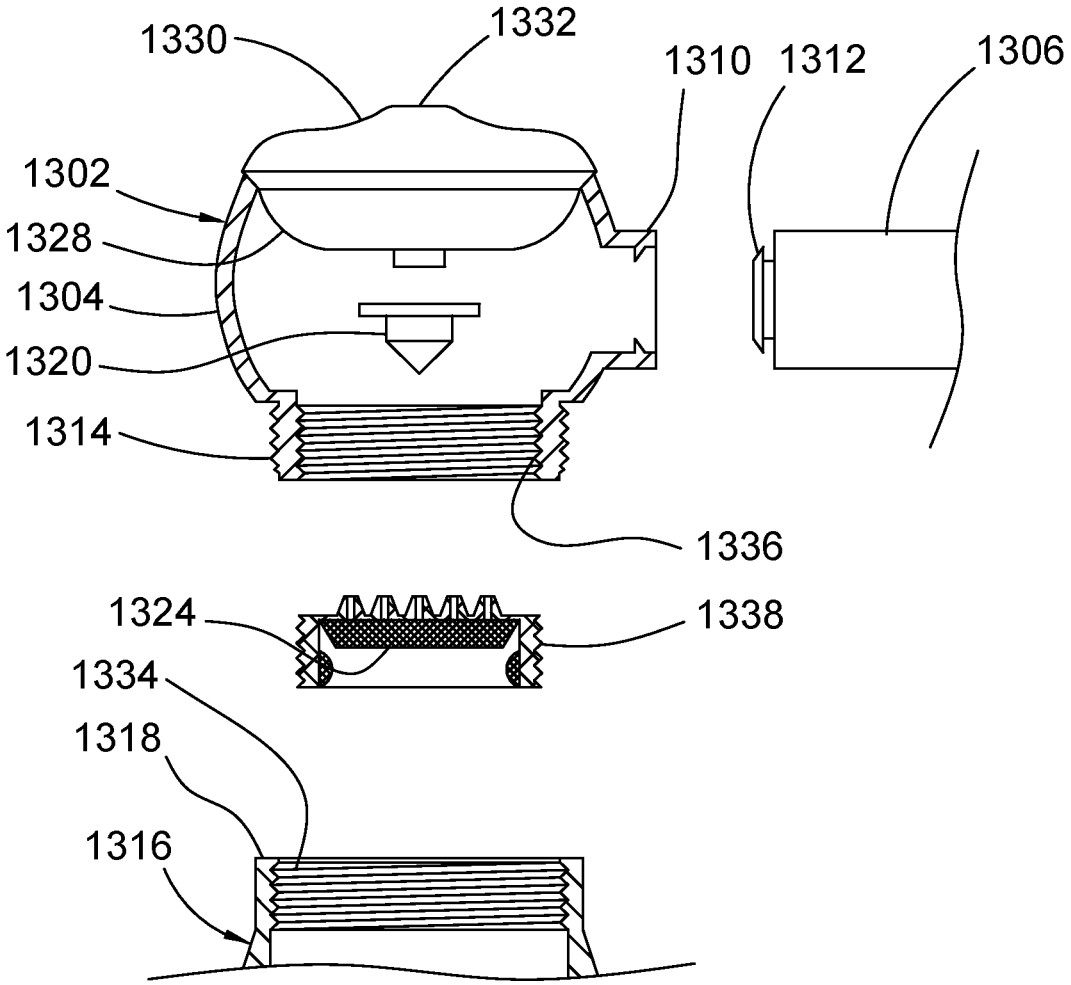
FIG. 14 shows a side cross sectional view of a smoking pipe apparatus, in accordance with some embodiments.
Figure 15:
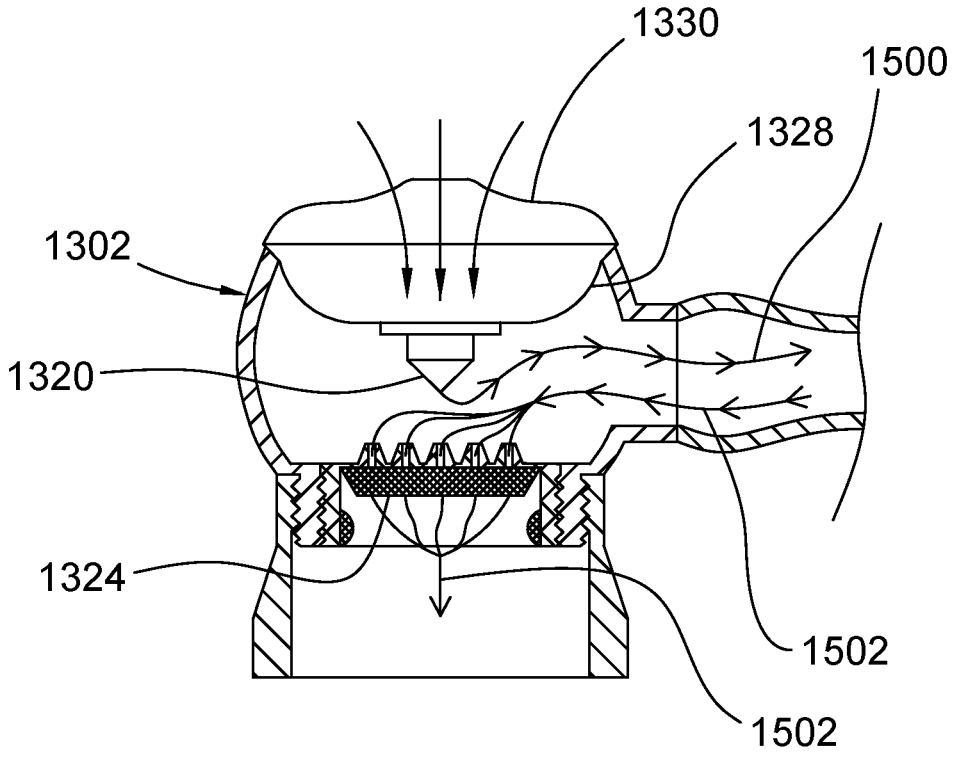
FIG. 15 shows operation of a smoking pipe apparatus, enabling the user to blow smoke back into the device to filter the smoke, in accordance with some embodiments.

FIG. 13 shows a side-exploded view of a smoking pipe apparatus 1300, in accordance with some embodiments. The smoking pipe apparatus 1300 is similar to that shown in FIGS. 1-9, but uses two valve elements. The apparatus 1300 includes a pipe body 1302 that has a bowl portion 1304 and a stem portion 1306. A mouthpiece can be formed at the distal end 308 of the stem portion 1306. The stem portion 1306 show here can be detachable from the bowl portion 1304 by attaching the proximal end 1312 of the stem portion 1306 to the coupling boss 1310 or similar feature formed on the bowl portion 1304. A lower extension 1314 can be a substantially cylindrical wall that is threaded on both the inside and outside. The outside threads couple with corresponding threads in the top 1318 of the filter element 1316. The inside threads of the lower extension allow a threaded valve insert member 1322 to be installed in the lower extension 1314. The valve insert member 1322 can include a flapper valve 1324. A duckbill valve 1320 can be located in the bowl chamber of the bowl portion 1304 of the pipe body 1302 under a bowl 1328. A bowl retainer 1326 can be coupled to the top of the bowl portion 1304 to retain the bowl 1328. Finally, a bowl cover 1330 can be retained in the top of the bowl retainer 1326. In this arrangement, the bowl cover 1330 has no top opening, and is only in place when the user is not smoking with the pipe apparatus 1300. Instead, the duckbill valve 1320 prevents gasses exhaled into the pipe apparatus from flowing upwards through the bowl 1328, and causes the flapper valve 1324 to open, allowing the gasses to pass through the filter element 1316. FIG. 14 shows a side cross sectional view of a smoking pipe apparatus 1300, specifically showing the detail of the valve insert element 1322 and lower extension 1314. The lower extension 1314 has threads 1336 on the inside that mate with threads 1338 on the outside of the valve insert element 1322. Similarly the threads on the outside of the lower extension 1314 mate with threads 1334 on inside of the top 1318 of the filter element 1316. The flapper valve 1324 is positioned in the valve insert element 1322 to normally cover openings though a floor or similar horizontal barrier in the valve insert element 1322. FIG. 15 shows the assembled apparatus 1300 in a cross sectional view indicating that smoke can be drawn in the direction of arrow 1500 and exhaled in the direction of arrow 1502.

Figure 16:
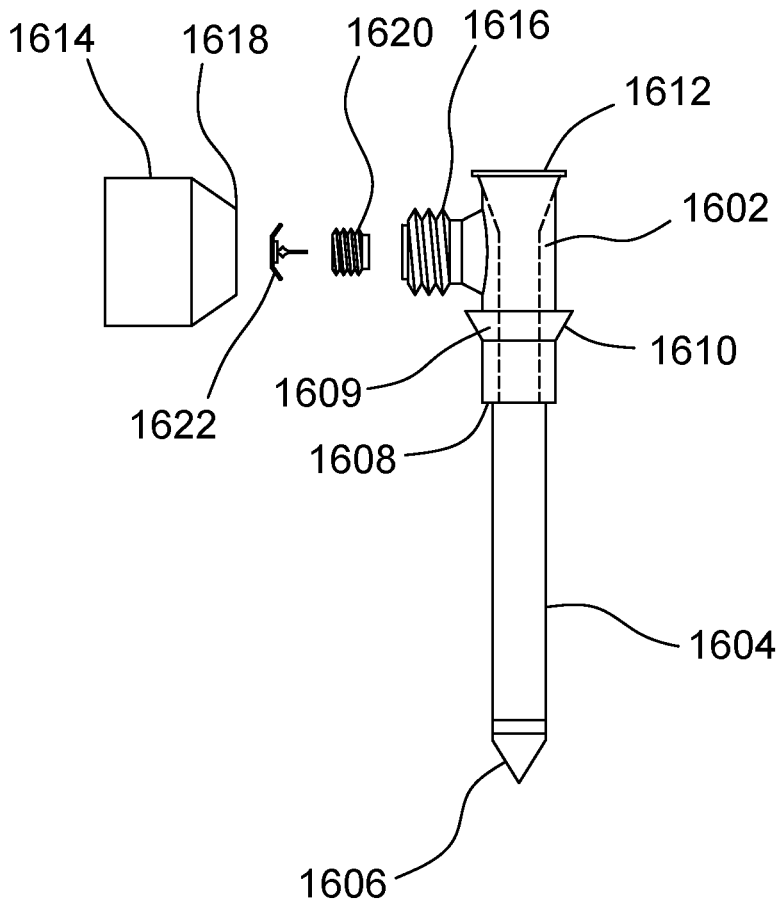
FIG. 16 shows design for smoking pipe device designed to be used in a water pipe, which allows a user to blow smoke back into the water pipe and re-direct the smoke into a filter element, in accordance with some embodiments.
Figure 17:
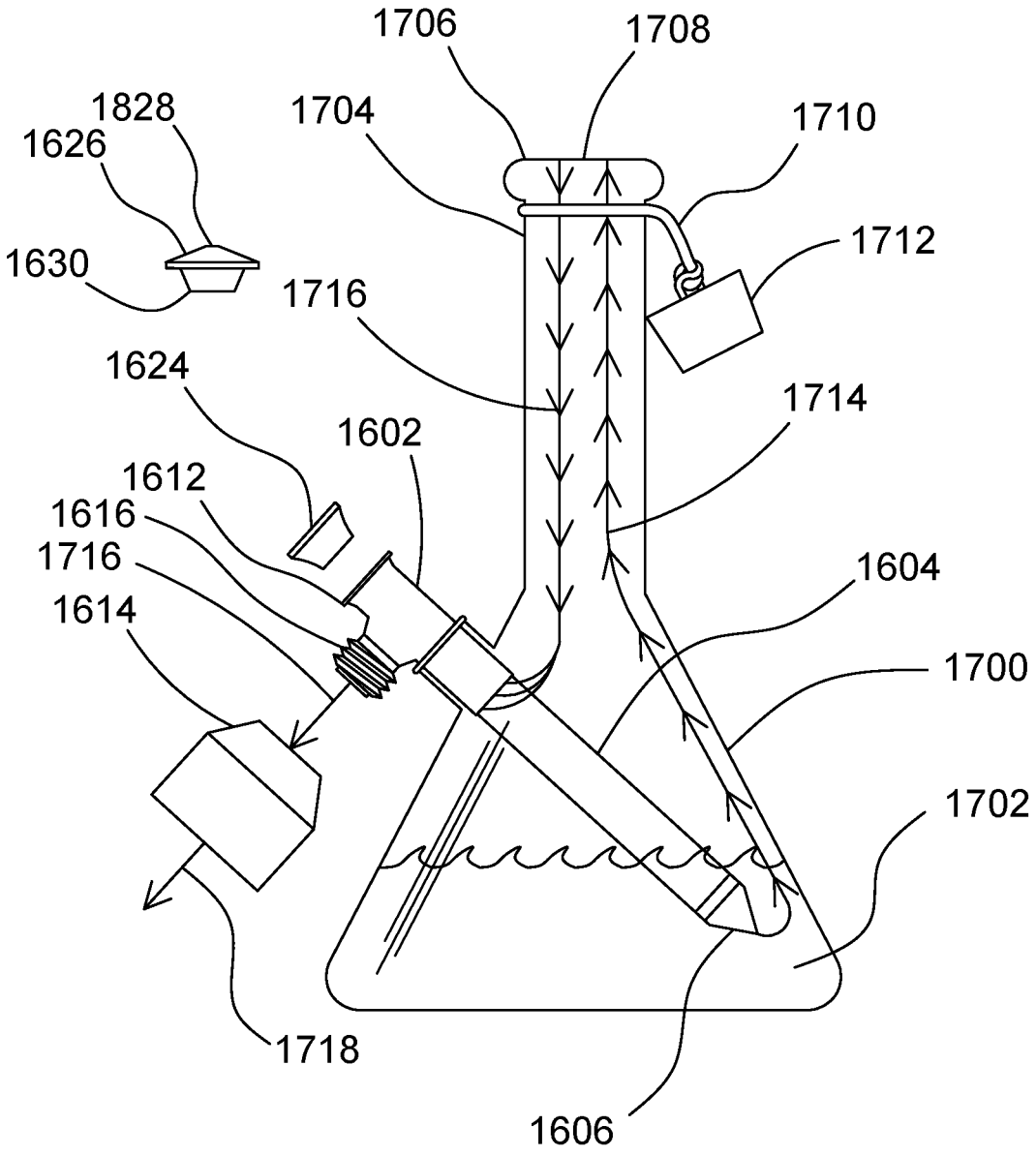
FIG. 17 shows operation of a smoking pipe apparatus in a water pipe, enabling the user to blow smoke back into the device to filter the smoke, in accordance with some embodiments.

FIGS. 16 and 17 show a design for smoking pipe device 1600 designed to be used in a water pipe 1700, which allows a user to blow smoke back into the water pipe 1700 and re-direct the smoke into a filter element 1614, in accordance with some embodiments. A pipe body 1602 has a top 1612 that is open to a downtube 1604, through which air can pass. At the bottom of the downtube is a duckbill valve 1606 or equivalent check valve. A skirt portion 1608 of the pipe body 1602 surrounds the downtube 1604 such that there is a gap 1609 between the inside of the skirt portion 1608 and the outside of the downtube 1604, which connects to an extension portion 1616 which extends away from the downtube 1604. The extension portion 1616 is similar to the lower extension 1314 of apparatus 1300, and is threaded on the inside and outside. The outside threads are configured to mate with corresponding threads of the filter element 1614 at the top 1618 of the filter element 1614. The threads on the inside of the extension portion 1616 are configured to mate with threads on the outside of a valve insert element 1620 that holds a flapper valve 1622 or equivalent check valve.

The device 1600 can be coupled to a water pipe 1700 by placing the downtube into a spout 1701 on the reservoir portion 1702 of the water pipe 1700. The distal end of the downtube 1604 with the duckbill valve 1606 is submerged under water. The water pipe 1700 also has a vertical tube portion 1704 with a top lip 1706 that forms a mouthpiece at an opening 1708. A bowl 1624 can be placed into the top 1612 of the pipe body 1602, and a cover 1626 can go over the bowl when the pipe is not in use. Upon placing smoking material into the bowl 1624 and providing an ignition source to ignite the smoking material, the user can inhale through the top 1706 of the vertical tube portion 1704, drawing air through the bowl, downtube 1604, duckbill valve 1606, water in the reservoir 1702, and up the vertical tube portion 1704 as indicated by line 1714. The flapper valve 1622 prevents air from being drawn through the filter element 1614. When the user exhales into the vertical tube portion 1704, the duckbill valve 1606 prevent the increased pressure in the pipe from letting water travel up the downtube 1604, but causes the flapper valve 1622 to open, allowing the exhaled gases to pass through the gap 1609 between the skirt 1608 and downtube 1604, through the extension 1616, past the flapper valve 1622, and through the filter 1614 as indicated by line 1716, and through the filter element 1614 where filtered air 1718 exits the filter element 1614. It should be understood that, although the filter element 1614 is shown here is disconnected from the extension 1616, that the filter element 1614 will be coupled to the extension 1616 during operation. A lanyard 1710 and cap 1712 can be used to close the opening 1708 at the top 1706 of the vertical tube portion 1704 when the pipe 1700 is not in use.

The inventive disclosure provides a smoking pipe apparatus that can be used to minimize the amount of smoke emitted into an area when using the pipe apparatus. The pipe apparatus is modular, allowing the pipe body to be used without a filter element in a more conventional manner, or with a filter element. When used with the filter element, the pipe apparatus includes structure that allows the user to operate the pipe apparatus in a way then ensures exhaled gasses pass through the filter element. The pipe body can be fitted with a one-way valve under floor of the bowl chamber which only opens when the pressure in the bowl cavity is high enough to open the valve and allow gasses to pass the valve. When the pipe body is coupled to the filter, then gasses passing the valve will also pass through the filter element.

What is claimed is:

1. A smoking pipe apparatus, comprising:

a pipe body having a bowl portion and a stem portion, the bowl portion having a bowl cavity therein, a retention shoulder formed around a top opening at a top side of the pipe body, the retention shoulder including an extension which extends upward from the top side of the pipe body and includes a retention ledge that extends outward from the extension, wherein there is a gap between the top side of the pipe body and the retention ledge, the bowl cavity having a floor, the floor having a plurality of openings therethrough, the pipe body further having a lower extension that extends downward from a bottom of the bowl portion;

a bowl that is configured to fit into the bowl cavity, the bowl having a top lip that rests against a top of the of the retention shoulder when the bowl in placed into the bowl cavity;

wherein the stem portion extends from the bowl portion and include a bore through the stem portion that is contiguous with the bowl cavity;

a one-way valve disposed on a bottom of the floor of the bowl cavity, wherein the one-way valve normally closes off the plurality of openings through the floor and further when a pressure inside the bowl cavity is lower than an ambient pressure outside the smoking pipe apparatus, and wherein the one-way valve opens when the pressure inside the bowl cavity is higher than the ambient pressure;

a bowl retainer that is separate from the bowl and that is configured to mate with and be removably retained by the retention shoulder of the pipe body and to retain the bowl in the bowl cavity of the pipe body, the bowl retainer having a lower inward facing retention lip that fits into the gap between the top side of the pipe body and the retention ledge, the bowl retainer further having a top opening; and a bowl cover that is configured to fit into and be retained at the top opening of the bowl retainer and having a lower retaining lip, the bowl cover having an opening through the bowl cover, wherein when the bowl cover is retained at the top opening of the bowl retainer, and the bowl retainer is retained by the retention shoulder, the lower retaining lip of the bowl cover makes contact with a top of the bowl in the bowl cavity to thereby retain the bowl in the bowl cavity.

2. The smoking pipe apparatus of claim 1, wherein the pipe body further includes an opening through a side wall of the bowl portion to the cavity.

3. The smoking pipe apparatus of claim 1, further including a filter element that is configured to couple to the lower extension of the pipe body and retain the pipe body on the filter element.

4. The smoking pipe apparatus of claim 1, wherein the one-way valve is a flapper valve that is removably coupled to the floor of the cavity of the bowl portion of the pipe body.

5. The smoking pipe apparatus of claim 1, wherein the pipe body is made of silicone.

6. The smoking pipe apparatus of claim 1, wherein the bowl cover is made of glass.

7. The smoking pipe apparatus of claim 1, wherein the lower extension of the pipe body has a bottom, the bottom having a front portion and a back portion, the back portion being under a location on the bowl portion where the bowl portion couples to the stem portion, and wherein the back portion of the lower extension extends further downward than the front portion of the lower extension such that the bottom of the lower extension is angled.

8. The smoking pipe apparatus of claim 7, wherein the bottom of the lower extension is angled between twenty and thirty degrees relative to horizontal.

9. A smoking pipe apparatus, comprising:

a pipe body including a bowl portion and a stem portion, the stem portion extending from a side of the bowl portion;

the bowl portion having a bowl cavity having an opening at a top of the bowl portion, the bowl cavity having a floor;

the bowl portion having a retaining shoulder formed on a top of the bowl portion around the opening of the bowl cavity;

the stem portion having a bore through the stem portion that connects to the bowl cavity;

the floor of the bowl cavity having a plurality of vent extensions that extend upwards from the floor, each vent extension of the plurality of vent extensions having a vertical channel through the vent extension that further passes through the floor of the bowl cavity; and a lower extension that extends downward from a bottom of the bowl portion, the lower extension having a bottom, the bottom having a front portion and a back portion, the back portion being under a location on the bowl portion where the bowl portion couples to the stem portion, and wherein the back portion of the lower extension extends further downward than the front portion of the lower extension such that the bottom of the lower extension is angled.

10. The smoking pipe apparatus of claim 9, further comprising:

a one-way valve disposed on a bottom of the floor of the bowl cavity, wherein the one-way valve normally closes off each channel through the plurality of vent extensions as well as when a pressure inside the bowl cavity is lower than an ambient pressure outside the smoking pipe apparatus, and wherein the one-way valve opens when the pressure inside the bowl cavity is higher than the ambient pressure.

11. The smoking pipe apparatus of claim 10, further comprising a filter element having:

a grove configured to receive the bottom of the lower extension of the pipe body;

an extension wall that extend into an opening formed by the lower extension;

the top of the extension wall having a plurality of notches that allow gasses to pass into the filter element when the one-way valve is opened.

12. The smoking pipe apparatus of claim 9, further comprising:

a bowl configured to fit into the bowl cavity, the bowl having a lip that rests on a top of the retention shoulder when the bowl is inserted into the bowl cavity, the bowl having a plurality of openings through a floor of the bowl;

a bowl retainer that is configured to mate with and be removably retained by the retention shoulder of the pipe body and to retain the bowl in the bowl cavity of the pipe body when retained by the retention shoulder, the bowl retainer further having a top opening; and a bowl cover that is configured to fit into and be retained at the top opening of the bowl retainer, the bowl cover having an opening through to bowl cover.

13. The smoking pipe apparatus of claim 9, wherein the bottom of the lower extension is angled between twenty and thirty degrees relative to horizontal.

14. The smoking pipe apparatus of claim 9, wherein the bowl portion has a side opening through a wall of the bowl portion to the bowl cavity.

* * * * *